US010850465B2

(12) United States Patent
Lear

(10) Patent No.: US 10,850,465 B2
(45) Date of Patent: Dec. 1, 2020

(54) SCREW PRESS APPARATUS INCLUDING AN IMPROVED CIP ARRANGEMENT AND METHOD OF CLEANING THE APPARATUS

(71) Applicant: GEA Process Engineering A/S, Søborg (DK)

(72) Inventor: Alexander William Lear, Kingston-upon-Thames (GB)

(73) Assignee: GEA Process Engineering A/S (DK)

( * ) Notice: Subject to any disclaimer, the term of this patent is extended or adjusted under 35 U.S.C. 154(b) by 0 days.

(21) Appl. No.: 16/307,603

(22) PCT Filed: Jun. 7, 2017

(86) PCT No.: PCT/DK2017/050187
§ 371 (c)(1),
(2) Date: Dec. 6, 2018

(87) PCT Pub. No.: WO2017/211369
PCT Pub. Date: Dec. 14, 2017

(65) Prior Publication Data

US 2019/0255792 A1 Aug. 22, 2019

(30) Foreign Application Priority Data

Jun. 7, 2016 (WO) ..... PCT/DK2016/050167

(51) Int. Cl.
*B30B 9/12* (2006.01)
*B30B 15/00* (2006.01)

(52) U.S. Cl.
CPC ..... *B30B 9/125* (2013.01); *B30B 9/12* (2013.01); *B30B 15/0082* (2013.01)

(58) Field of Classification Search
CPC ..... B30B 15/0082; B30B 9/062; B30B 9/06; B30B 9/121; B30B 9/12; B30B 9/125
See application file for complete search history.

(56) References Cited

U.S. PATENT DOCUMENTS 3,738,629 A * 6/1973 Coleman ..... C21D 1/667 266/117
3,938,434 A * 2/1976 Cox ..... B30B 9/12 100/117

(Continued)

FOREIGN PATENT DOCUMENTS

CA 2170360 A1 * 3/1995 ..... B01D 35/16
CN 205272650 U 6/2016

(Continued)

*Primary Examiner* — Shelley M Self
*Assistant Examiner* — Jared O Brown
(74) *Attorney, Agent, or Firm* — Condo Roccia Koptiw LLP

(57) ABSTRACT

The invention relates to a screw press apparatus (1) comprising an outer casing (2) surrounding a screening tube (6*a*) with a plurality of liquid discharge holes, a slurry inlet port (3) at one end of the screening tube and a solids discharge port (4) at an opposite end of the screening tube, the screening tube housing an axially located auger (5), the outer casing (2) having a first opening in fluid communication with the slurry inlet port (3), a second opening in fluid communication with the solids discharge port (4), and a third opening (8) in fluid communication with the liquid discharge holes of the screening tube (6), a cleaning device (20) located between the outer casing and the screening tube, a device (10) for axially moving the cleaning device. The cleaning device (20) has a rigid co-axial liquid supply pipe (30) having at least one washing pipe (21, 22, 23, 24) at least partially surrounding the screening tube (6), each at least one washing pipe (21, 22, 23, 24) containing a plurality of nozzles (211, 221, 231, 241) facing the screening tube (6*a*). The screw press apparatus is especially suited for processing protein containing slurries, and in another aspect the invention relates to a method of producing a gluten product using the screw press apparatus.

20 Claims, 4 Drawing Sheets

(56) References Cited

U.S. PATENT DOCUMENTS

| | | | | | |
|---|---|---|---|---|---|
| 4,221,228 | A | * | 9/1980 | Stoffel | B08B 3/02 118/316 |
| 4,705,055 | A | * | 11/1987 | Rohm | B01D 29/25 134/57 R |
| 5,193,446 | A | * | 3/1993 | Olusczak | A23N 1/003 99/486 |
| 5,357,855 | A | * | 10/1994 | Ishigaki | B30B 9/12 100/112 |
| 5,417,155 | A | * | 5/1995 | Tatsuzawa | B30B 9/121 100/112 |
| 6,156,128 | A | * | 12/2000 | Zierler | B01D 29/014 134/16 |
| 6,615,710 | B1 | * | 9/2003 | Ishigaki | B01D 29/118 100/111 |
| 7,918,347 | B2 | * | 4/2011 | Geisbauer | B01D 29/23 210/391 |
| 2014/0261547 | A1 | * | 9/2014 | Thomas | B08B 9/043 134/8 |
| 2015/0076085 | A1 | | 3/2015 | Theodoulou et al. | |

FOREIGN PATENT DOCUMENTS

| | | | | | |
|---|---|---|---|---|---|
| CN | 205705408 | U | | 11/2016 | |
| DK | 201670409 | A1 | | 6/2016 | |
| JP | 06292997 | A | * | 10/1994 | B30B 9/166 |
| JP | H06 292997 | A | | 10/1994 | |
| JP | 2001-149707 | A | | 6/2001 | |
| JP | 2002-219312 | A | | 8/2002 | |
| JP | 2003 205390 | A | | 7/2003 | |
| JP | 2004 090049 | A | | 3/2004 | |
| JP | 4128276 | B2 | | 5/2008 | |
| JP | 2011 000607 | A | | 1/2011 | |
| WO | WO-0117642 | A2 | * | 3/2001 | B01D 11/0226 |
| WO | WO 2015/064176 | A1 | | 5/2015 | |

* cited by examiner

SCREW PRESS APPARATUS INCLUDING AN IMPROVED CIP ARRANGEMENT AND METHOD OF CLEANING THE APPARATUS

CROSS REFERENCE TO RELATED APPLICATIONS

This application is the National Stage Entry under 35 U.S.C. § 371 of Patent Cooperation Treaty Application No. PCT/DK2017/050187, filed 07 Jun. 2017, which claims priority from Patent Cooperation Treaty Application No. PCT/DK2016/050167, filed 07 Jun. 2016, the contents of which are hereby incorporated by reference herein.

FIELD OF INVENTION

The present invention relates to a screw press apparatus comprising an outer casing surrounding a screening tube defining a longitudinally extending axial direction and with a plurality of liquid discharge holes, a slurry inlet port at one end of the screening tube and a solids discharge port at an opposite end of the screening tube, the screening tube housing an axially located auger, the outer casing having a first opening in fluid communication with the slurry inlet port, a second opening in fluid communication with the solids discharge port, and a third opening in fluid communication with the liquid discharge holes, a cleaning device located between the outer casing and the screening tube, and a device for axially moving the cleaning device. The screw press apparatus is especially suited for producing a protein product and other sticky products, such as a vital wheat gluten product.

The invention furthermore relates to a method for cleaning a screw press apparatus, to a method of producing a sticky product, and to a method of producing a gluten product.

BACKGROUND OF THE INVENTION

Screw presses are employed for dewatering and concentrating protein slurries in order to provide protein products for use in human food or animal fodder. For example, wheat flour containing starch and protein (gluten) is processed to separate the starch from protein, and the resulting protein slurry can be processed further in a screw press to dewater and concentrate the protein—the concentrated protein product obtained from wheat is commonly referred to as "vital wheat gluten". In industrial scale production of food material hygiene is of particular importance in order to prevent contamination of the product, e.g. with microbial germs or the like. Therefore screw presses and other apparatuses must be monitored and cleaned on a regular basis. Protein slurries, especially gluten slurries, represent an especially problematic starting material since they can form tough, elastic and sticky masses that can block the screen in a screw press, which will inevitably reduce the productivity of a screw press.

When a slurry, e.g. a slurry of protein in water, such as a slurry of gluten in water or other sticky products, is treated in a screw press apparatus, solids may build up at the discharge holes, which will eventually block the discharge holes to a point where the screw press apparatus can no longer dewater slurry entering. The discharge holes must therefore be cleaned in order for the screw press apparatus to function. Moreover, since proteins produced at industrial scale are rarely sterile build-up of material in a screw press apparatus at locations in the vicinity of the screening tube can present a risk of microbial contamination of the product.

Several examples exist of devices for cleaning a screw press apparatus. For example JP 2003205390 discloses a cleaning device of a screw press having a cleaning pipe that surrounds the outer periphery of the filtration tube, and which can be moved in the axial direction of the filtration tube. The cleaning pipe has a plurality of injection nozzles facing the filtration tube. The system is intended mainly for processing sewage sludge and appears ill-suited for a screw press for producing sticky food products where hygiene is important.

Another example is disclosed in U.S. Pat. No. 6,615,710, which has a cleaning pipe for ejecting cleaning water to the screen of a screw press. The device has limited flexibility, which may also limit its utility in a screw press for producing a food product.

US 2015/076085 adds a level of flexibility to the device of U.S. Pat. No. 6,615,710 by allowing the screen to rotate so that the full circumference of the screen can be washed.

One problem with the above-mentioned solutions is that intense spraying for cleaning generates a substantial amount of water which has to be drained, either through separate drainage means thus requiring additional equipment, or through the normal drainage system of the apparatus which in turn may lead to too high water levels and overflow.

Another problem with the above-mentioned solutions is that they cannot completely wash and rinse off sticky products that have built up over time.

SUMMARY OF THE INVENTION

With this background, it is therefore an object of the present invention to provide a screw press apparatus comprising an outer casing surrounding a screening tube with a plurality of liquid discharge holes, a slurry inlet port at one end of the screening tube and a solids discharge port at an opposite end of the screening tube, the screening tube housing an axially located auger, the outer casing having a first opening in fluid communication with the slurry inlet port, a second opening in fluid communication with the solids discharge port, and a third opening in fluid communication with the liquid discharge holes of the screening tube, a cleaning device located between the outer casing and the screening tube, a device for axially moving the cleaning device, which screw press apparatus is suited for processing of materials with high requirements of hygiene.

It is a further object to provide an apparatus by which the general operational conditions are improved.

In a first aspect of the invention, these and further objects are obtained by a cleaning device having a rigid co-axial liquid supply pipe having at least one washing pipe at least partially surrounding the screening tube, each at least one washing pipe containing a plurality of nozzles facing the screening tube.

The cleaning device has a rigid co-axial liquid supply pipe. In the context of the invention "co-axial" should be interpreted to encompass all such configurations in which the axis of the liquid supply pipe is generally parallel to the axial direction as defined by the screening tube of the screw press apparatus. The liquid supply pipe may also be said to be "par-axial", "axis-parallel" or "having a parallel axis" etc., and in the context of the invention these terms are used interchangeably.

The screw press apparatus of the invention employs a cleaning device having a rigid co-axial liquid supply pipe, which with the aid of the device for axially moving the cleaning device can be moved inside the apparatus. The possibility for axial movement of the cleaning device provides flexibility with respect to cleaning the screening tube that cannot be afforded with a fixed cleaning installation. The configuration of the cleaning device makes it possible to provide a closed system which is of particular significance in the case of manufacture of food products. The rigid co-axial liquid supply pipe thus functions as a lance which allows the cleaning device to be moved axially entirely within the outer housing. Furthermore, the amount of water required is reduced.

In an embodiment, the rigid co-axial liquid supply pipe enters the outer casing through an appropriate opening, preferably through a single water-tight gland. It is further preferred that the surface of the liquid supply pipe is substantially smooth. These features, either alone or in combination, provide that the cleaning device itself can be easily cleaned and sanitized. In particular, when the surface of the liquid supply pipe is smooth and when the entry point into the outer casing is a water-tight gland it is possible to prevent build-up of contaminations in the water-tight gland. Moreover, the part of the cleaning device at any time present inside the screw press apparatus represents a minimal distribution pipework with no hoses and in particular also having no moving parts inside the housing. In a specific embodiment the rigid co-axial liquid supply pipe is connected to a hose connection at an end of the rigid co-axial liquid supply pipe located outside the outer casing.

For example, the hose connection may be connected to the at least one liquid supply tube, each in fluid communication with the washing pipe and accommodated in the rigid co-axial liquid supply pipe. The cleaning device thus preferably does not comprise any moving parts within the outer casing. The cleaning device further preferably does not comprise hosing within the outer casing, i.e. hosing outside of the liquid supply pipe. With no hosing and no moving parts there are few, if any, locations for contaminations to be trapped inside the housing thereby reducing the risk of contamination of the protein slurry or the product. This is particularly relevant for production of food products for human consumption or products for animal fodder where e.g. microbial contamination is unacceptable.

The screw press apparatus of the invention is scaled for industrial scale of operation, e.g. it is capable of processing up to about 10 tonnes per hour of slurry. The advantages of being able to clean the screening tube while at the same time avoiding build-up of contaminations is considered particularly relevant for industrial scale, e.g. for screw press apparatuses capable of treating at least 1 ton per hour of slurry, since the cleaning device of the invention removes the need to dismantle the screw press apparatus for cleaning, which in turn allows the screw press apparatus to be operated on a continuous basis for extended periods of time, e.g. for several days or weeks of operation. By the configuration of the inventive screw press apparatus, it is even possible to wash part of or the entire screw press while other parts are in operation.

The screw press apparatus of the invention comprises an outer casing. The outer casing may have any shape desired, for example the outer casing may have a rectangular or circular transverse cross-sectional shape. The material of the outer casing may be chosen freely but it is preferred that the material is capable of withstanding cleaning and sanitization operations typically used in food manufacturing. For example, the material is preferably able to withstand temperatures of about 120° C., high concentration of sodium hydroxide, and organic solvents for prolonged periods of time. The material is preferably stainless steel.

The outer casing preferably encloses the screening tube in order to prevent contamination of the screening tube. When the outer casing encloses the screening tube the outer casing will have appropriate openings for entering and discharging material from the screw press. Any opening in the outer casing may be provided with closure mechanisms allowing the screw press apparatus to be isolated when access to the screw press is not needed. For example, the first opening in fluid communication with the slurry inlet port may comprise a hopper or the like with a closable door. Likewise, the second opening in fluid communication with the solids discharge port may comprise a tank or reservoir for intermediate storage of the product, which tank or reservoir can be fitted with a closable member.

The shape and the material of the screening tube may likewise be selected freely as long as the function of the screening tube is ensured. The same considerations as for material of the outer casing apply for the screening tube, and furthermore the screening tube should be able to withstand pressures building up during operation. It is preferred that the screening tube has a round cross-section.

The screening tube has a slurry inlet port at one end of the screening tube and a solids discharge port at an opposite end. The slurry inlet port is in fluid communication with a first opening of the outer casing, and the solids discharge port is in fluid communication with a second opening of the outer casing. The outer casing further has a third opening in fluid communication with the liquid discharge holes. In the context of the invention "fluid communication" means that a fluid, e.g. a liquid, a slurry, a flowable solid, paste, etc., can enter into one end of the fluid communication and exit via the other end of the fluid communication. In particular, the elements in fluid communication in the apparatus of the invention are in discrete fluid communication so that the fluids cannot be mixed.

The slurry inlet port and the solids discharge port may have any design, e.g. with respect to size, as desired. For example, a protein slurry having a water content in the range of 65% to 80%, a protein content in the range of 65% to 85%, and a content of other solids, e.g. carbohydrates, such as starch, of less than 30% is applied at the slurry inlet port, i.e. via the first opening. Once inside the screening tube the auger is rotated to push the slurry from one end, i.e. the inlet end, towards the opposite end, i.e. the exit end, so that the auger squeezes water out of the slurry and into the liquid discharge holes thereby dewatering the slurry and providing a dewatered protein product at the solids discharge port. The auger may have any design as appropriate but at least comprises a helical conveyor or vane on a shaft that can be rotated in the screening tube. The auger is thus capable of moving the slurry upon rotation of the shaft. For example, in one embodiment clockwise rotation of the auger will move the slurry from the slurry port towards the solids discharge port, and in another embodiment counter-clockwise rotation of the auger will move the slurry from the slurry port towards the solids discharge port.

In one embodiment the distance between the surface of the shaft and the inner wall of the screening tube decreases from the slurry inlet port towards the solids discharge port. For example, the shaft may have a conical shape with the wide end of the shaft facing the solids discharge port and the narrow end of the shaft facing the slurry inlet port. In another embodiment the screening tube has a conical shape with the wide end of the screening tube facing the slurry inlet port and the narrow end of the screening tube facing the solids discharge port. In yet a further embodiment the screening tube and the shaft are cylindrical and pitch of the helix of the conveyor or vane decreases towards the solids discharge port.

The screening tube has a plurality of liquid discharge holes. The screening tube is surrounded by a concentric support tube with larger holes. The liquid discharge holes are distributed on the surface of the screening tube, e.g. at regular distances between the discharge holes. The liquid discharge holes serve to remove water, or other liquid that has been squeezed out of the protein slurry by rotation of the auger, and the discharge liquid can subsequently be removed from the apparatus via the third opening in the outer casing. The discharge holes are typically round and have a diameter in the range of 0.5 mm to 1 mm. In a specific embodiment, the cross-sectional area of the discharge holes decreases from the slurry inlet port towards the solids discharge port.

The cleaning device has a rigid co-axial liquid supply pipe having a washing pipe at least partially surrounding the screening tube. In the context of the invention "surrounding" is to be understood with respect to the positioning of the plurality of nozzles facing the screening tube. It is thus preferred that nozzles representing the plurality of nozzles of the washing tube are located such that any part of the circumference of the screening tube can be sprayed with water, or another cleaning liquid, from the nozzles. In an embodiment of the invention the washing pipe contains 4 to 16 nozzles, preferably evenly distributed around the screening tube. Since the cleaning device can be moved axially in the screw press apparatus the full surface, e.g. along the full length, of the screening tube can be washed.

The washing tube may have any shape and may be prepared from any material. In a specific embodiment the washing tube is made from a rigid material, e.g. stainless steel or a thermoplastic polymer. In a certain embodiment the washing pipe fully surrounds the screening tube. When the washing tube fully surrounds the screening tube the structure allows operation of the cleaning device at increased pressure, e.g. up to about 60 bar of water or more, since the structure stabilizes the washing tube. This is particularly relevant when the washing tube is made from stainless steel or similarly rigid material.

The nozzles may have any design desired. In an embodiment of the invention the nozzles are positioned on the washing ring so as to define a right angle between an exit line of the nozzle and the surface of the screening tube; in this context this exit line is referred to as a "normal exit line". In another embodiment the exit line of the nozzle has an angle of ±45° to the normal exit line, e.g. in respect to the axial direction of the screening tube. Regardless of the exit angle of the nozzles, the nozzles may provide a straight line of washing liquid or the washing liquid may exit the nozzle in a cone. In a particular embodiment, the nozzles are high pressure nozzles. For example, the nozzles may be capable of operating with an applied pressure of washing liquid of up to 60 bar or more. The use of cleaning liquid, e.g. water, at high pressure, e.g. at about 30 to 60 bar, is especially advantageous in the processing wheat gluten to produce vital wheat gluten. The gluten of wheat has a large content of sulphur containing amino acids, which are capable cross-linking as disulphide bridges between different gluten molecules, which can turn the gluten mass into a sticky and elastic material prone to blocking the discharge holes. Protein, e.g. gluten protein, is an excellent substrate for unwanted microorganisms and therefore in the production of vital wheat gluten the need for cleaning the screening tube is especially pronounced. Thus by using a high pressure of washing liquid in the screw press of the invention, contamination, especially microbial contamination, of the vital wheat gluten can be minimized or even prevented. The same is considered true for gluten of other types of grain, and the advantages observed for processing of wheat gluten apply equally for gluten obtained from other grains. The invention is equally applicable to other sticky products fed in the form of a slurry containing the sticky product and having a predefined water content.

The screening tube may be considered to represent two or more zones. For example, a first zone may be from the slurry inlet port to a certain distance, e.g. half the distance, of the length of the screening tube, and a second zone may be the remaining distance to the solids discharge port. Likewise, the screening tube may also be divided into three or more zones. In general, a first zone is upstream from a second zone, which is upstream of a third zone etc. with respect to the screening tube. Since the material contained inside the screening tube of the screw press apparatus will have an increasing solids content from the slurry inlet port towards the solids discharge port and likewise a lower water content, different washing requirements may be presented from the slurry inlet port towards the solids discharge port. With the rigid nature of the co-axial liquid supply pipe the position of the washing pipe relative to the screening tube is known, and the washing conditions, e.g. the pressure and amount of water or other washing liquid, can be adjusted to the washing requirements of a specific location, e.g. a specific zone, of the screening tube.

The screening tube is washed when sprayed with water from the one or more washing pipes upon axial movement of the rigid co-axial liquid supply pipe. The rigid co-axial liquid supply pipe can be moved over a stroke from a first position corresponding to washing of the end of the screening tube having the slurry inlet port to a second position corresponding to washing of the end of the screening tube having the solids discharge port. In an embodiment of the invention the rigid co-axial liquid supply pipe has two or more washing pipes distributed in a longitudinal direction of the rigid co-axial pipe with a distance between each washing pipe corresponding to the stroke of the supply pipe. This embodiment allows that the full surface of the screening tube can be washed with a single stroke of the supply pipe while the stroke of the rigid co-axial liquid supply pipe being shorter than the full length of the screening tube. This limits the amount of installation space required for the screw press apparatus, and in particular since no moving parts are required inside the outer casing the locations where build-up of contaminations could otherwise occur are minimized.

In an embodiment of the invention the rigid co-axial liquid supply pipe has two or more washing pipes each at least partially surrounding the screening tube, and each washing pipe containing a plurality of nozzles facing the screening tube. In particular, each washing pipe may be located to wash a specific zone of the screening tube. When the rigid co-axial liquid supply pipe has two or more washing pipes a more robust cleaning system is provided, which can at the same time wash several parts of the screening tube. By simultaneously washing several parts of the screening tube it is possible to more efficiently address potential build-up of solid material in the discharge holes, which in turn allows a lower consumption of water or other cleaning liquid.

When the rigid co-axial liquid supply pipe has two or more washing pipes, the liquid supply pipe may have a discrete supply line, e.g. in the form of a tube, for each washing pipe, which may be inside the supply pipe, so that each washing pipe can be supplied with washing liquid under different conditions, e.g. with respect to pressure and volume. This allows that each zone of the screening tube is washed under conditions appropriately matching the build-up or potential build-up of solids in the discharge holes of the respective zones.

In another embodiment the rigid co-axial pipe contains two or more liquid supply tubes each in fluid communication the washing pipe, e.g. the same washing pipe or different washing pipes when relevant. The washing pipe may have a set of nozzles for each liquid supply, or the two liquid supplies may provide a single set of nozzles in a washing pipe with washing liquid under different conditions. For example, a first liquid supply tube may be a low-pressure supply tube and another liquid supply tube may a high-pressure supply tube. Likewise, a first liquid supply tube may be for water, and another supply tube may be for another washing liquid. When two discrete liquid supplies are employed the cleaning conditions at a specific location of the screening tube can be switched more quickly than when the same liquid supply is operated with changing conditions. For example, a low pressure of washing liquid may be employed to keep the outer surface of the screening tube moist and short bursts of high pressure washing liquid may be employed to remove built-up solids in the discharge holes.

In a second aspect the invention provides a method of cleaning a screw press apparatus comprising the steps of: providing screw press apparatus according to the invention and applying a cleaning liquid through the rigid co-axial liquid supply pipe at a pressure in the range of 3 bar to 60 bar to wash the discharge holes of the screening tube. The method is appropriately employed during production of a protein product from a protein containing slurry applied at the slurry inlet port. The protein containing slurry is typically applied at a rate in the range of 1 ton/hour to 15 tonnes/hour. The method of cleaning a screw press apparatus of the invention is especially advantageous since it allows continuous operation of the screw press apparatus for prolonged periods of time, e.g. a week or more and furthermore the method may be performed during continued operation and without dismantling the screw press apparatus.

In yet a further aspect the invention provides a method of producing a gluten product. The method comprises applying a gluten slurry having a water content in the range of 65% to 80%, a protein content in the range of 65% to 85%, and a content of other solids, e.g. carbohydrates, such as starch, of less than 30%, applying a cleaning liquid through the rigid co-axial liquid supply pipe at a pressure in the range of 3 bar to 60 bar to wash the discharge holes of the screening tube, and obtaining the gluten product from the solids discharge port. The method advantageously allows the production of a gluten product having a moisture content below 68%. For example, the moisture content may be below 65%, such as below 60%. The method further advantageously allows continuous operation over a period of at least 1 week. In a specific embodiment the gluten product is obtained at a rate in the range of 1 ton/hour to 15 tonnes/hour.

BRIEF DESCRIPTION OF THE DRAWINGS

The invention will be described in more detail below by means of non-limiting examples of presently preferred embodiments and with reference to the schematic drawings, in which.

DETAILED DESCRIPTION OF EMBODIMENTS OF THE INVENTION

Figure 1:
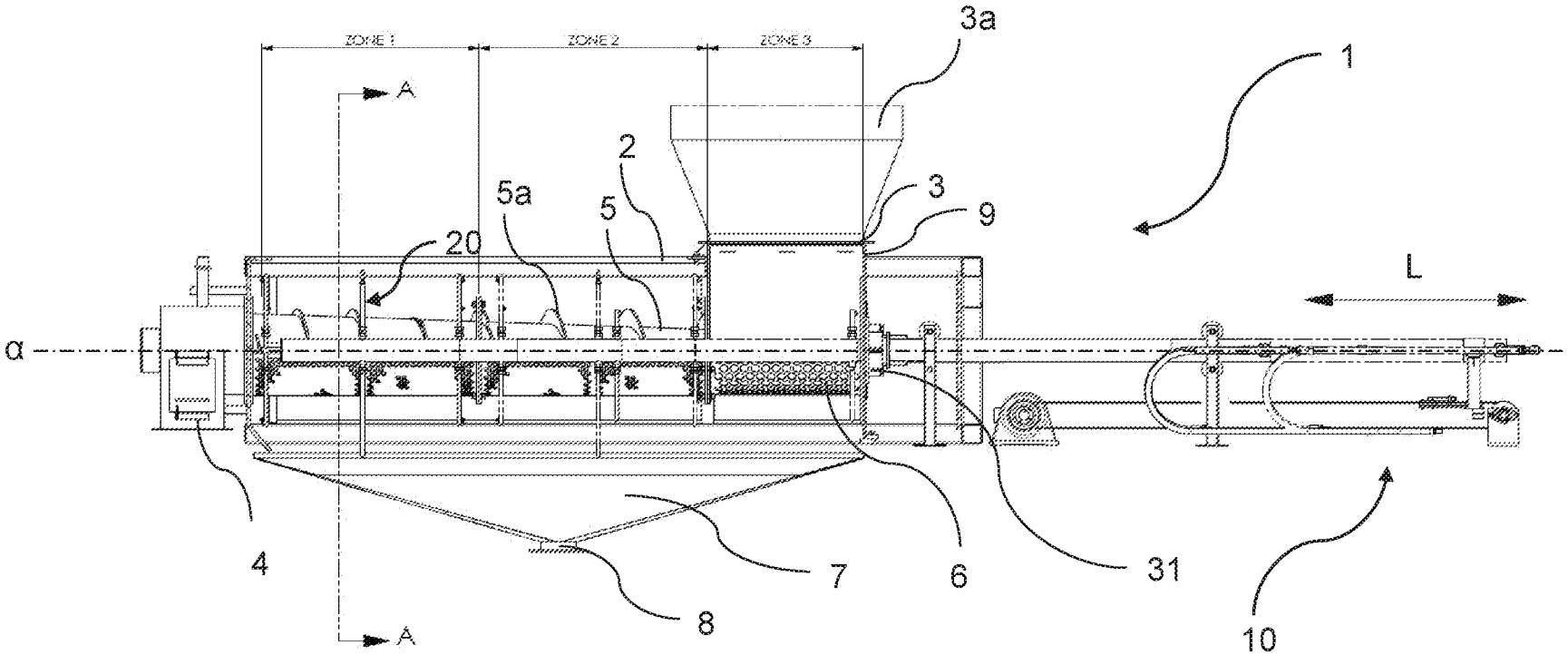
FIG. 1 shows a part-sectional plan view of a screw press apparatus in an embodiment of the present invention.

FIGS. 1 to 5 show an embodiment of the screw press apparatus 1 of the invention. The screw press apparatus 1 generally comprises an outer casing 2 surrounding a screening tube 6*a* (cf. FIG. 3) with a plurality of liquid discharge holes (not shown in detail). The screening tube 6*a* is in the embodiment shown accommodated in a concentrically arranged support tube 6. The support tube 6 is also provided with openings (not shown in detail) but of a larger dimension than the discharge holes of the perforated screening tube 6*a*. A slurry inlet port 3 is provided at one end of the support tube 6 and a solids discharge port 4 is provided at an opposite end of the screening tube. Furthermore, the support tube 6 and the screening tube 6*a* house an axially located auger 5.

The outer casing 2 has a first opening (not shown in detail) in fluid communication with the slurry inlet port 3, a second opening (not shown in detail) in fluid communication with the solids discharge port 4, and a third opening 8 in fluid communication with the liquid discharge holes of the screening tube 6*a*, here via a funnel-shaped section 7.

In the embodiment shown, the screw press apparatus 1 has an outer casing 2 made of stainless steel AISI316, which fully surrounds the screening tube 6*a*, so that access to the screening tube 6*a* by the operator is prevented. The outer casing 2 has a hopper 3*a* providing fluid communication with the slurry inlet port 3 for applying an aqueous protein slurry or another starting material to the screw press apparatus 1. The hopper 3*a* is likewise made of stainless steel although a thermoplastic material is equally relevant for the hopper. Only a section is shown of the support tube 6 and the screening tube 6*a*, at the zone of the apparatus labelled as "zone 3", although it is to be understood that the support tube 6 and the screening tube 6*a* cover the full length of the axially located auger 5, i.e. zone 1, zone 2 and zone 3. The plurality of liquid discharge holes of the screening tube 6*a* are round and of the same diameter and equally distributed over the surface of the screening tube 6*a*. The auger 5 has a predefined taper and a helical conveyor 5*a* so that rotation of the auger 5 will move the slurry towards the solids discharge port 4. Liquid discharge is guided via funnel-shaped section 7 and further out of the third opening 8 to suitable drainage means (not shown). The support tube 6 and the screening tube 6*a* define a longitudinally extending axial direction a, indicated in FIGS. 1 and 4.

As will be described in further detail below, the screw press apparatus 1 comprises a cleaning device 20 located between the outer casing 2 and the screening tube 6*a* and a device 10 for axially moving the cleaning device 20. The device 10 for axially moving the cleaning device 20 is located outside the outer casing 2 and is capable of axially moving the cleaning device 20 over a stroke L.

Figure 2:
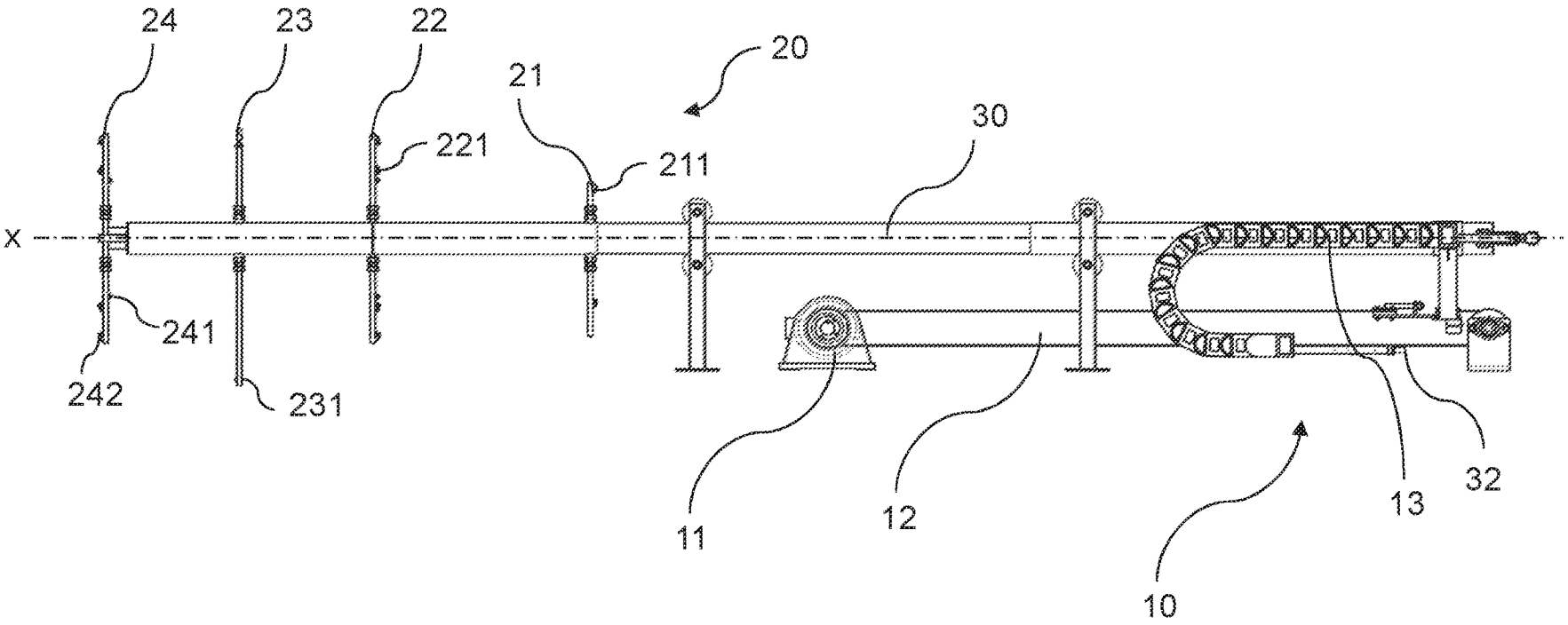
FIG. 2 shows a plan view of a detail of the screw press apparatus of FIG. 1, on a larger scale.
Figure 3:
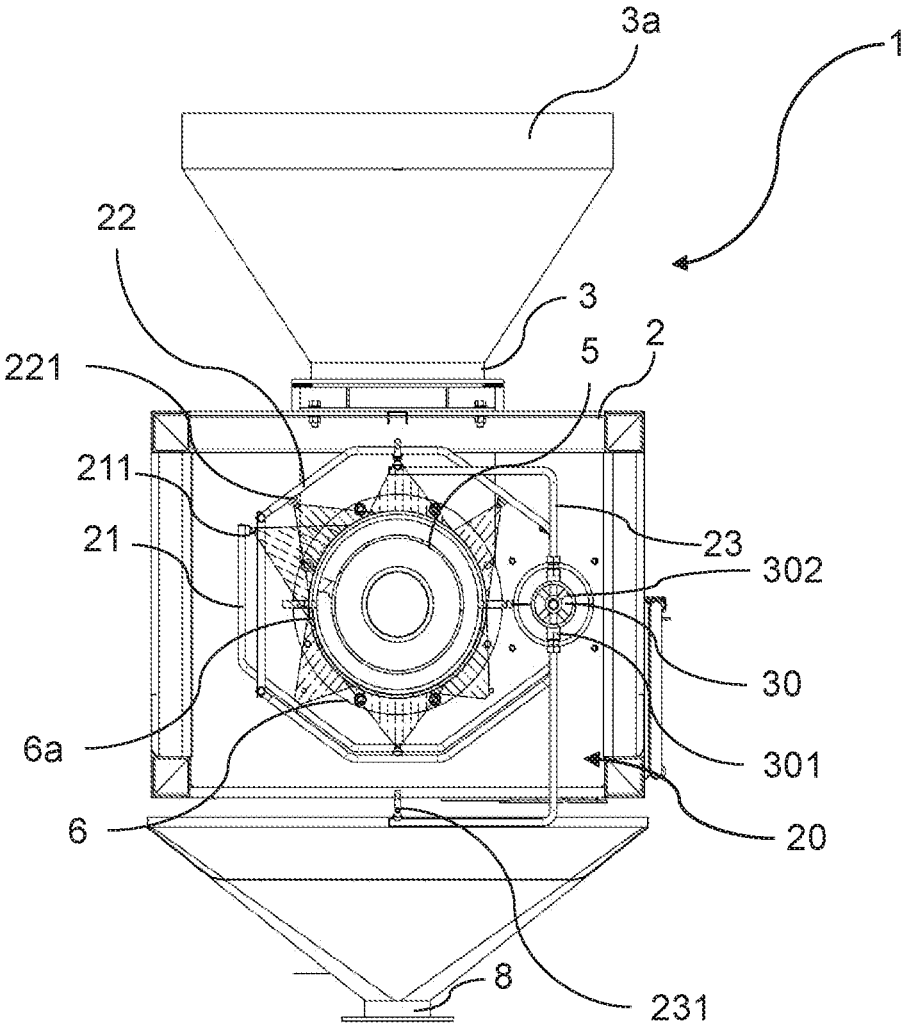
FIG. 3 is a cross-sectional view along the line A-A of FIG. 1.
Figure 4:
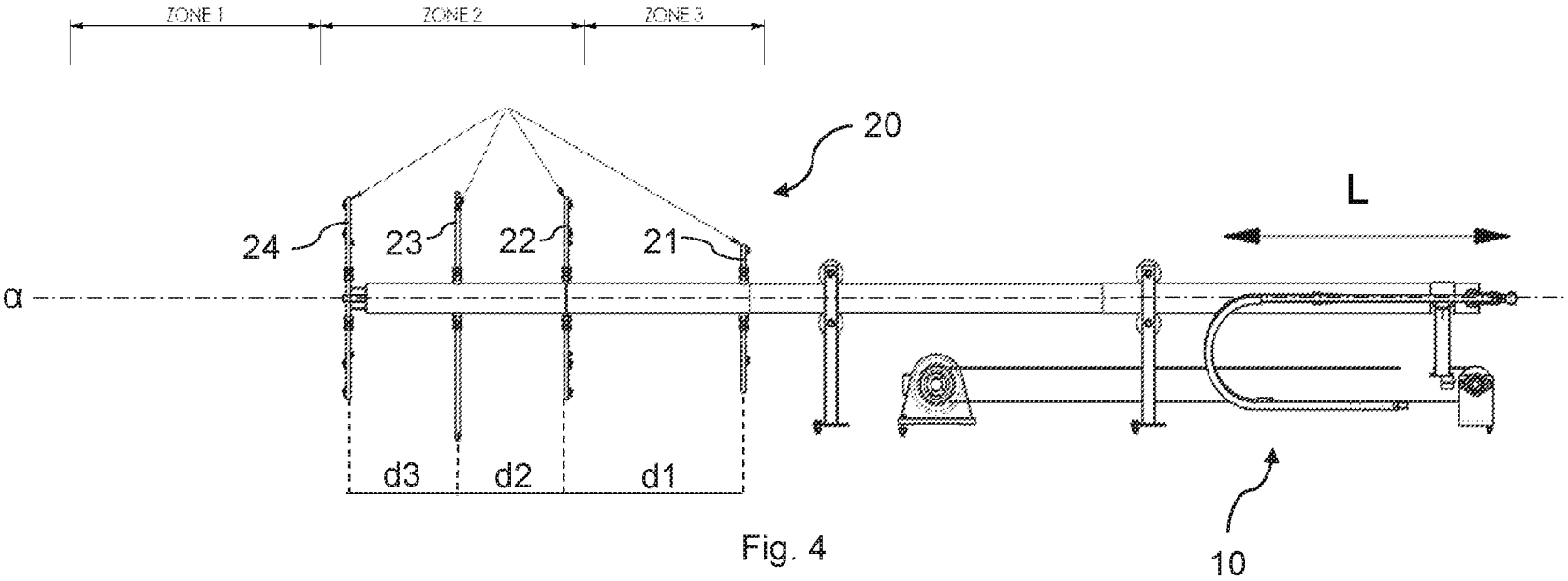
FIGS. 4 and 5 show schematic views corresponding to FIG. 2 of the screw press apparatus in two different positions.

A plan view of a detail of the screw press apparatus 1 of FIG. 1 is shown in FIG. 2. The cleaning device 20 has a rigid liquid supply pipe 30 defining a longitudinal axis x as shown in FIG. 2. In FIG. 3, the longitudinal axis x of the rigid liquid supply pipe 30 hence extends in a direction perpendicular to the paper plane, but is not indicated for the sake of clearness and ease of reading. The axial direction a as defined by the screening tube 6*a* is not shown in FIG. 3 either, and, as is readily understood, the extension of the axial direction at the center of the screening tube 6*a* is also perpendicular to the paper plane in FIG. 3. In FIG. 4, the indication of the longitudinal axis x would be substantially superimposed on the shown longitudinally extending axial direction a of the screening tube 6*a*, and thus of the concentric support tube 6. Thus, in the context of the invention "co-axial" is used synonymously for such configurations in which the axis of the liquid supply pipe is generally parallel to the longitudinal axis of the screening tube itself and hence extends in the axial direction defined by the screening tube. The cleaning device 20 has the rigid co-axial liquid supply pipe 30 with washing pipes 21, 22, 23, 24, which washing pipes have nozzles 211, 221, 231, 241 facing and capable of washing the full perimeter of the screening tube 6*a*. The rigid co-axial liquid supply pipe 30 enters the outer casing 2 via a water-tight gland 31. The device 10 for axially moving the cleaning device, as depicted in FIG. 2, comprises a motor 11 with a gear (not shown) for belt 12 thereby causing axial movement of the rigid co-axial liquid supply pipe 30. The device 10 may in principle be any suitable linear actuator capable of providing the required stroke L. The piping including the flexible hoses represented by the hose connection 32 and supported by flexible hose support 13 are capable of withstanding a pressure of at least 100 bar, and the other end of the hose connection 32 is connected to a high pressure liquid supply system (not shown). It is to be understood that the hose connection 32, the motor 11 and other parts of the device 10 for axially moving the cleaning device 20 are located outside the outer casing 2, even though this is not shown in FIG. 2.

The screw press apparatus 1 of FIG. 1 is depicted cross-sectionally in FIG. 3 along the line A-A indicated in FIG. 1. Thus, FIG. 3 shows the outer casing 2 surrounding the support tube 6 and in turn the screening tube 6*a*. The outer casing 2 is depicted as having a square cross-section and is provided with an end wall 9, but the outer casing 2 is not limited to having a square cross-section; the cross-section could likewise be round or have another rectangular shape. The auger 5 and the screening tube 6 are shown having round cross-sections. The slurry inlet port 3 is shown on top of the outer casing 2, and thereby also on top of the support tube 6 and the screening tube 6*a* so that a slurry present in the hopper will enter the screening tube 6*a* due to gravity. Likewise, the third opening 8 is below the screening tube 6*a*.

The screw press apparatus 1 is shown as being positioned substantially horizontally. However, it is also conceivable to position the screw press apparatus 1 is an inclined position.

Generally, the rigid co-axial liquid supply pipe 30 has two or more washing pipes in preferred embodiments. Here, four washing pipes including a first washing pipe 21, a second washing pipe 22, a third washing pipe 23, and a fourth washing pipe 24 are provided, each at least partially surrounding the screening tube 6. Each washing pipe 21, 22, 23, 24 is provided with a plurality of nozzles 211, 221, 231, 241 facing the screening tube 6*a*. It is also advantageous if at least one of the washing pipes 21, 22, 23, 24 comprises one or more nozzles directed in another direction than towards the screening tube 6. In the embodiment shown, the fourth washing pipe 24 is shown with one such nozzle 242, In principle, the washing pipes may take any suitable form and configuration, either open or closed in a cross-sectional view. In the embodiment shown as is discernible from FIG. 3, the first washing pipe 21 and the third washing pipe 23 each has an open configuration. The open configuration may for instance be in the form of a V, a U or a Y, the first washing pipe 21 thus having a substantially Y-shaped configuration, whereas the third washing pipe 23 has the shape substantially as a stylized C.

The second washing pipe 22 and the fourth washing pipe 24 each has a closed configuration in the form of polygonal shape.

The spray pattern of representative nozzles 211, 221 and 231 are indicated in the cross-sectional view of FIG. 3, the fourth washing pipe 24 being not visible in this cross-section.

For instance, the second washing pipe 22 may be provided with a high pressure nozzle 221 which can spray the surface of the screening tube 6*a* with washing liquid in an angle of about 60°.

The cleaning device 20 may as indicated in FIG. 3 be provided with separate internal supply conduits 301 and 302, either for supplying different cleaning liquids, or one and the same cleaning liquid at different pressures.

Throughout the above description it is understood that the terms cleaning liquid and washing liquids are used interchangeably. Furthermore, it is understood that terms such as "directed towards" the screening tube 6*a* are to be interpreted as covering also the presence of the support tube 6, as the cleaning liquid here reaches the screening tube 6*a* via the openings of the support tube 6.

Figure 5:
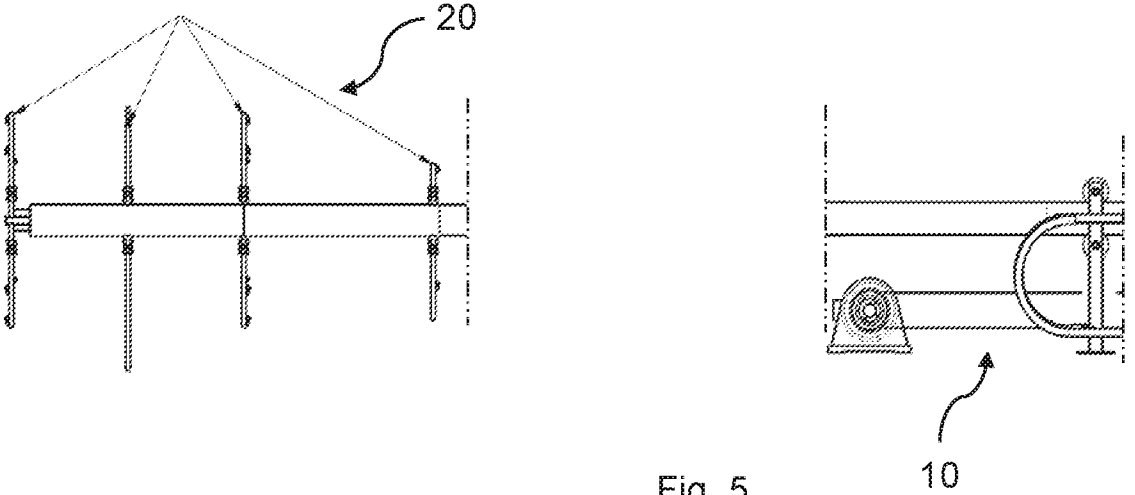

Referring now in particular to FIGS. 4 and 5, the cleaning device 20 is shown in two different positions, relative to zone 1, zone 2 and zone 3 of the outer casing 2 and in turn of the screening tube 6*a*.

It is preferred that the washing pipes 21, 22, 23, 24 are distributed axially, that is in the generally longitudinal direction as defined by the longitudinally extending axial direction a of the screening tube 6*a*, and thus in turn along the longitudinal axis x of the rigid co-axial liquid supply pipe 30, with a distance d1, d2, d3 between the respective washing pipes 21, 22, 23, 24. In order to provide optimum coverage of the spraying of the screening tube 6, it is advantageous that the distance d1, d2, d3 do not exceed the stroke L or at most corresponds to the stroke L of the rigid co-axial liquid supply pipe 30.

The rigid co-axial liquid supply pipe 30 of the cleaning device 10 is shown schematically in the two different positions in FIGS. 4 and 5, which illustrate how the full length of the screening tube 6*a* can be washed with one stroke L of the rigid co-axial liquid supply pipe 30, which stroke L is much shorter than the full length of the screening tube 6*a* when the cleaning device 20 has multiple washing pipes appropriately distributed over the length of the rigid co-axial liquid supply pipe 30.

During operation, the slurry is fed to the screw press apparatus 1 via hopper 3*a* and further to slurry inlet port 3. The slurry is dewatered as the auger 5 rotates and the excess water is squeezed through the perforations of the screening tube 6*a* and openings in the support tube 6 and drained off from the third opening 8. The sticky product is obtained from the solids discharge port 4.

When washing of the screw press apparatus 1 is desired, for instance according to a pre-defined cleaning regime, a cleaning liquid is supplied through the rigid co-axial liquid supply pipe 30 and further to the cleaning device 20. The cleaning liquid is sprayed through the nozzles 211, 221, 231, 241 associated to the respective washing pipes 21, 22, 23, 24. As described in the above, the cleaning liquid may be applied to some of the nozzles 221 at high pressure, for instance at 30 to 60 bar or even higher, whereas the cleaning liquid is supplied to other nozzles at a lower pressure, either at an intermediate pressure level of 10 to 30 bar, or at a relatively low pressure, for instance 3 to 10 bar. By the movement of the cleaning device 20 by the device 10, the screw press apparatus 1 is washed in the various zones, zone 1, zone 2 and zone 3. The washing is able to take place also during normal operation of the screw press apparatus 1, i.e. during the production of the sticky product such as a gluten product.

The invention should not be regarded as being limited to the embodiments shown and described in the above, but various combinations and modifications are conceivable.

LIST OF REFERENCE NUMERALS

1 screw press apparatus
2 outer casing
3 slurry inlet port
  3*a* hopper
4 solids discharge port
5 auger
  5*a* helical conveyor
6 concentric support tube for the screening tube
  6*a* screening tube
7 funnel-shaped section
8 third opening (drainage opening)
9 end wall of outer casing
10 device for axially moving cleaning device
11 motor
12 belt
13 flexible hose support
20 cleaning device
  21 first washing pipe
    211 nozzle
  22 second washing pipe
    221 nozzle
  23 third washing pipe
    231 nozzle
  24 fourth washing pipe
    241 nozzle
30 rigid co-axial liquid supply pipe
31 water-tight gland
32 hose connection
301 internal supply conduit
302 internal supply conduit

The invention claimed is:

1. A screw press apparatus comprising:

an outer casing surrounding, a screening tube defining a longitudinally extending axial direction, the screening tube comprising a plurality of liquid discharge holes, a slurry inlet port at one end of the screening tube and a solids discharge port at an opposite end of the screening tube, the screening tube housing an axially located auger, the outer casing having a first opening in fluid communication with the slurry inlet port, a second opening in fluid communication with the solids discharge port, and a third opening in fluid communication with the liquid discharge holes of the screening tube, a cleaning device located between the outer casing and the screening tube, wherein the cleaning device has a rigid co-axial liquid supply pipe configured to be moved axially between the slurry inlet port and the solids discharge port, the supply pipe having a substantially smooth surface, which is generally parallel to the axial direction as defined by the screening tube, and wherein the rigid co-axial liquid supply pipe comprises two or more washing pipes, each washing pipe at least partially surrounding the screening tube, each washing pipe comprising a plurality of nozzles facing the screening tube, the two or more washing pipes being distributed in the longitudinally extending axial direction along a longitudinal axis of the rigid co-axial liquid supply pipe, with a distance between the respective washing pipes not exceeding a stroke of the rigid co-axial liquid supply pipe, and wherein the rigid co-axial liquid supply pipe engages a water-tight gland disposed at an opening in the outer casing, and wherein the liquid supply pipe extends through the outer casing.

2. A screw press apparatus according to claim 1, wherein the rigid co-axial liquid supply pipe is connected to a hose connection at an end of the rigid co-axial liquid supply pipe, and wherein the end of the rigid co-axial liquid supply pipe is located outside the outer casing.

3. A screw press apparatus according to claim 2, wherein the hose connection is connected to at least one internal supply conduit, each in fluid communication with the two or more washing pipes and accommodated in the rigid co-axial liquid supply pipe.

4. A screw press apparatus according to claim 2, wherein the hose connection is connected to an internal low-pressure supply conduit and an internal high-pressure supply conduit, each supply conduit being in fluid communication with the two or more washing pipes and accommodated in the rigid co-axial liquid supply pipe.

5. A screw press apparatus according to claim 1, wherein at least some of said plurality of nozzles are capable of operating with an applied pressure of washing liquid of 60 bar or more.

6. A screw press apparatus according to claim 1, wherein at least one of the two or more washing pipes has an open configuration in the form of a V, a U, or a Y.

7. A screw press apparatus according to claim 1, wherein at least one of the two or more washing pipes has a closed configuration in the form of a circle, a rectangle, or any other polygonal shape.

8. A screw press apparatus according to claim 1, wherein at least one of the two or more washing pipes comprises at least one additional nozzle directed in another direction than towards the screening tube.

9. A screw press apparatus according to claim 1, wherein the cleaning device does not comprise any moving parts within the outer casing.

10. A screw press apparatus according to claim 1, wherein the cleaning device does not comprise any hosing within the outer casing.

11. A screw press apparatus according to claim 1, wherein the screening tube is accommodated in a concentrically arranged support tube.

12. A screw press apparatus according to claim 1 further comprising a motor for axially moving the rigid co-axial liquid supply pipe.

13. A screw press apparatus according to claim 1 further comprising a linear actuator for axially moving the rigid co-axial liquid supply pipe.

14. A method of cleaning a screw press apparatus, the method comprising:

providing a screw press apparatus according to claim 1, and applying a cleaning liquid through the rigid co-axial liquid supply pipe at a pressure in the range of 3 bar to 60 bar to wash the plurality of liquid discharge holes of the screening tube.

15. A method of producing a sticky product, the method comprising:

providing a screw press apparatus according to claim 1, applying a slurry comprising a sticky product and having a predefined water content, applying a cleaning liquid through the rigid co-axial liquid supply pipe at a pressure in the range of 3 bar to 60 bar to wash the plurality of liquid discharge holes of the screening tube, and obtaining the sticky product from the solids discharge port.

16. A method of producing a gluten product, the method comprising:

providing a screw press apparatus according to claim 1, applying a gluten slurry having a water content, a protein content and a content of other solids, applying a cleaning liquid through the rigid co-axial liquid supply pipe at a pressure in the range of 3 bar to 60 bar to wash the plurality of liquid discharge holes of the screening tube, and obtaining the gluten product from the solids discharge port.

17. The method according to claim 16, wherein the gluten product has a moisture content below 68%.

18. The method according to claim 16, wherein applying the gluten slurry is performed continuously over a period of at least 1 week.

19. The method according to claim 16, wherein the gluten product is obtained at a rate in the range of 1 ton/hour to 15 tonnes/hour.

20. The method according to claim 16, wherein the cleaning liquid is applied during normal operation of the screw press apparatus.

* * * * *